US010465725B2

(12) United States Patent
Shan et al.

(10) Patent No.: US 10,465,725 B2
(45) Date of Patent: Nov. 5, 2019

(54) CYLINDER HEAD BODY, SINGLE CYLINDER BOLT SYSTEM AND CRANE

(71) Applicant: Xuzhou Heavy Machinery Co., Ltd., Xuzhou, Jiangsu Province (CN)

(72) Inventors: Zenghai Shan, Xuzhou (CN); Quan Dong, Xuzhou (CN); Yongjian Deng, Xuzhou (CN); Chenglin Xiao, Xuzhou (CN); Feng Zhu, Xuzhou (CN)

(73) Assignee: Xuzhou Heavy Machinery Co., Ltd., Xuzhou, Jiangsu Province (CN)

( * ) Notice: Subject to any disclaimer, the term of this patent is extended or adjusted under 35 U.S.C. 154(b) by 118 days.

(21) Appl. No.: 15/554,958

(22) PCT Filed: Mar. 3, 2016

(86) PCT No.: PCT/CN2016/075395
§ 371 (c)(1),
(2) Date: Aug. 31, 2017

(87) PCT Pub. No.: WO2016/138864
PCT Pub. Date: Sep. 9, 2016

(65) Prior Publication Data

US 2018/0087546 A1 Mar. 29, 2018

(30) Foreign Application Priority Data

Mar. 3, 2015 (CN) ..... 2015 1 0095381

(51) Int. Cl.
*F15B 15/14* (2006.01)
*B66C 23/66* (2006.01)
(Continued)

(52) U.S. Cl.
CPC ..... *F15B 15/1428* (2013.01); *B66C 23/66* (2013.01); *B66C 23/708* (2013.01);
(Continued)

(58) Field of Classification Search
CPC .... F15B 15/1428; F15B 15/16; B66C 23/708; B66C 23/66; B66C 23/705; B66C 23/701
See application file for complete search history.

(56) References Cited

U.S. PATENT DOCUMENTS 4,373,851 A 2/1983 Confoey
4,395,192 A * 7/1983 Schlafly ..... E02F 3/286 212/349

(Continued)

FOREIGN PATENT DOCUMENTS

CN 201614985 U 10/2010
CN 101973493 A 2/2011

(Continued)

OTHER PUBLICATIONS

Written Opinion dated Jun. 13, 2016, issued in corresponding International Application No. PCT/CN2016/075395, filed Mar. 3, 2016, 10 pages.

(Continued)

*Primary Examiner* — Thomas E Lazo
(74) *Attorney, Agent, or Firm* — Christensen O'Connor Johnson Kindness PLLC

(57) ABSTRACT

The invention relates to a cylinder head body, a single cylinder bolt system and a crane, wherein, the cylinder head body comprises at least two branch bodies of cylinder head body, a cooperative positioning structure and a fixed connection structure are provided between two adjacent branch bodies of cylinder head body of the at least two branch bodies of cylinder head body, the branch body of cylinder head body has a cylindrical branch body structure, the cylindrical branch body structures of the at least two branch bodies of cylinder head body are cooperatively positioned by means of the cooperative positioning structure and are detachably connected by means of the fixed connection structure to form a barrel. The cylinder head body is com- (Continued)

posed of at least two branch bodies of cylinder head body in a dismountable way, which are cooperatively positioned and detachably connected by the cooperative positioning structure and the fixed connection structure, respectively, such that the cylinder head body may be dismounted into branch body structures during assembling, assembling manner thereof is not restricted by traditional assembling sequence, thereby improving the assembling efficiency and production efficiency. Moreover, the branch body structure of the cylinder had body is easy to dismount and maintain, which saves maintenance cost.

17 Claims, 3 Drawing Sheets

(51) Int. Cl.
*B66C 23/70* (2006.01)
*F15B 15/16* (2006.01)

(52) U.S. Cl.
CPC ..... *B66C 23/701* (2013.01); *B66C 23/705* (2013.01); *F15B 15/16* (2013.01)

(56) References Cited

U.S. PATENT DOCUMENTS 4,417,644 A * 11/1983 Brogard ..... B60R 25/001 180/287
6,189,712 B1 * 2/2001 Conrad ..... B66C 23/705 212/292
6,874,338 B1 * 4/2005 Hunt ..... E02F 9/24 70/14
9,909,279 B2 * 3/2018 D'Amico ..... E02F 3/388
2014/0353272 A1 12/2014 Nakamura et al.
2016/0200555 A1 * 7/2016 Shan ..... B66C 23/705 212/348

FOREIGN PATENT DOCUMENTS

CN 202250788 U 5/2012
CN 104279144 A 1/2015
CN 104649158 A 5/2015
JP 4092665 B1 5/2008

OTHER PUBLICATIONS

Extended European Search Report dated Sep. 26, 2018, issued in corresponding European Application No. 16758479.6, filed Mar. 3, 2016, 6 pages.
International Search Report dated Jun. 13, 2016, in International Application No. PCT/CN2016/075395, filed Mar. 3, 2016, 6 pages.
First Office Action dated Apr. 5, 2016, in CN Application No. 201510095381.0, filed Mar. 3, 2015, 11 pages.

* cited by examiner

CYLINDER HEAD BODY, SINGLE CYLINDER BOLT SYSTEM AND CRANE

TECHNICAL FIELD

The invention relates to the field of engineering machinery, especially a cylinder head body, a single cylinder bolt system and a crane.

BACKGROUND ART

Cranes, as devices for lifting weights and having a function of automatical movement, are widely applied in the field of engineering machinery. Among them, a single cylinder bolt system is a device built into a telescopic boom of the crane to assist the telescopic cylinder to realize the telescopic function of the telescopic boom of the crane. A single cylinder bolt system mainly consists of a telescopic boom and a cylinder, wherein main functional components for a hoist boom to realize extension and contraction include a cylinder head, a cylinder head body, a slide rail, a rail bracket, a boom pin, a cylinder pin, a dovetail groove, a driving cylinder, a detection switch and other auxiliary facilities.

The cylinder head is in a certain position of a cylinder barrel or a piston rod of the telescopic cylinder for controlling coupling and decoupling between the telescopic cylinder and the telescopic boom and between telescopic booms. The cylinder head mainly comprises a cylinder head body, a boom pin driving device, a cylinder pin driving device, a driving cylinder, a position detection block and so on. The cylinder head body is directly connected to the cylinder, for assembling the boom pin driving device, the cylinder pin driving device and carriers of other components, which is a major component of the cylinder head.

As a constituent part of the telescopic cylinder, the slide rail is assembled on the telescopic cylinder. It has a function of maintaining the position of the telescopic cylinder in the hoist boom slide and preventing the telescopic cylinder from spinning or flexing in the hoist boom. The rail bracket is also a constituent part of the telescopic cylinder, for assembling the slide rail, and it is generally welded on the cylinder barrel along the axial direction, and one telescopic cylinder has a number of rail brackets. The cylinder pin is a pin on the cylinder, which has a function of locking the cylinder and the telescopic boom together. In existing products, each cylinder head generally has two or four cylinder pins. The boom pin is a pin on the telescopic boom, which has a function of locking telescopic booms together. In existing products, each cylinder head generally has one or two boom pins. The cylinder pin rail is mounted within the cylinder head, whose structure is provided with a slide, along which the cylinder pin moves to realize telescopic motion of the cylinder pin. The boom pin rail is mounted within the cylinder head, whose structure is provided with a slide, along which the boom pin moves to realize unlocking motion of boom pin. The driving cylinder is an actuator for realizing motion of the boom pin and the cylinder pin.

Existing single-cylinder-bolt cylinder head bodies are all in one piece, forged or welded, which are inserted from one end of the cylinder during assembling of the cylinder. Ordinary cylinder head bodies are assembled on the piston rod, and they need to be inserted into the piston rod to be assembled. Assembling of multi-cylinder-head cylinders is more cumbersome. For a multi-cylinder-head cylinder, the cylinder head body needs to be assembled on the cylinder barrel. The cylinder barrel of the telescopic cylinder is welded with a flange connected to an end face flange of the cylinder body, and the cylinder barrel is assembled or welded with a rail bracket, so that the cylinder head body must be inserted into the cylinder barrel when assembled, then the cylinder head body and the flange are connected, then the rail bracket is assembled or welded, the slide rail is assembled on the rail bracket, and assembling of the cylinder is finished. In practical production process, cylinder heads may not be supplied in time, causing failure in sequential mounting. Moreover, dismounting is inconvenient during maintenance of the cylinder head body. If the slide rail and the cylinder barrel are connected in an assembling way, dismounting is more convenient, but it is still time-consuming. Generally the rail bracket and the cylinder barrel are welded together, because in this way, connection of the slide rail and the cylinder is more firm, which results in that the cylinder head body cannot be dismounted for maintenance.

FIG. 1 is a schematic view of the structure of an existing single-cylinder-bolt cylinder head body mounted on a telescopic cylinder. The cylinder head body a3 mounted on the cylinder barrel a1 is inserted from the bottom of the cylinder. Then the end face flange a4 of the cylinder head body a3 is connected to the flange bolt a5 welded on the cylinder barrel. Then the rail bracket a6 is assembled or welded, and then the slide rail a2 is assembled, this assembling sequence cannot be reversed. The cylinder head body a8 assembled on the cylinder rod a9 should be inserted by the cylinder rod a9 before the cylinder rod a9 is mounted in the cylinder barrel a1, and then connected to the cylinder barrel a1, such mounting sequence cannot be reversed, either, or it cannot be assembled because of influence of the end face flange a7 and the earring a10.

Therefore, existing cylinder head bodies have at least the following technical defects:

First, assembling is not flexible. In the telescopic cylinder, because of influence of the rail bracket, the flange, the earring, the valve seat and so on, the cylinder head body can only be inserted along the axial direction of one end of the cylinder barrel or the cylinder rod, i.e., the cylinder head body can only be inserted along the axial direction so as to be assembled.

Second, production efficiency is low. Affected by the assembling sequence, one cannot assemble other components first and assemble the cylinder head body at last. Insufficient supply of cylinder head bodies affects assembling of other components.

Third, maintenance is difficult. Both axial sides of the cylinder head body assembled on the cylinder barrel are welded or assembled with components besieging the cylinder head body, making it enclosed and impossible or inconvenient to dismount. For maintenance of the cylinder head assembled on the cylinder rod, the cylinder rod must be extracted first.

CONTENTS OF THE INVENTION

In order to overcome the abovementioned technical defects, the present invention provides a cylinder head body which is not restricted by the assembling sequence, to realize flexible mounting, convenient dismounting and maintenance, which is highly reliable.

In order to solve the abovementioned technical problem, the present invention provides a cylinder head body which comprises at least two branch bodies. A cooperative positioning structure and a fixed connection structure are provided between two adjacent branch bodies of cylinder head body of the at least two branch bodies of cylinder head body.

The branch body of cylinder head body has a cylindrical branch body structure. The cylindrical branch body structures of the at least two branch bodies of cylinder head body are cooperatively positioned by means of the cooperative positioning structure, and are detachably connected by means of the fixed connection structure to form a barrel.

In the basic technical solution, the cylinder head body is composed of at least two branch bodies of cylinder head body, which are cooperatively positioned and detachably connected by the cooperative positioning structure and the fixed connection structure, respectively. During assembling, the cylinder head body may be dismounted into branch body structures, assembling of which is not restricted by the assembling sequence, which avoids influencing assembling of other components of the cylinder due to insufficient supply of cylinder head bodies, improves assembling efficiency and production efficiency, facilitates dismounting and maintenance of the cylinder head body, and saves maintenance cost.

Preferably, the cooperative positioning structure comprises a rabbet cooperatively formed by a concave rabbet and a convex rabbet provided on the butting end faces of two adjacent branch bodies of cylinder head body of the at least two branch bodies of cylinder head body.

In the preferred technical solution, the cooperative positioning structure is a rabbet for centering and connection, positioning by the rabbet is accurate, such that branch bodies of cylinder head body are stressed axially into one piece, and two sides are stressed uniformly when stressed axially. Moreover, the rabbet is easy to obtain and has favorable feasibility.

Preferably, the cooperative positioning structure comprises a plurality of cooperating bosses and grooves respectively provided on the butting end faces of two adjacent branch bodies of cylinder head body of the at least two branch bodies of cylinder head body.

In the preferred technical solution, the cooperative positioning structure is formed by a plurality of cooperating bosses and grooves. The bosses and grooves are cooperatively positioned, such that the cylinder head is stressed axially into one piece. Moreover, bosses and grooves are easy to machine and have favorable feasibility.

Preferably, the plurality of cooperating bosses and grooves are provided equally spaced apart along the axial direction of the cylinder head body.

In the preferred technical solution, the plurality of cooperating bosses and grooves are provided equally spaced apart on the butting end faces, such that the barrel is stressed uniformly at both sides when stressed axially.

Preferably, the fixed connection structure comprises a connection plate provided on two adjacent branch bodies of cylinder head body of the at least two branch bodies of cylinder head body. The connection plate is provided with a bolt hole. Two adjacent branch bodies of cylinder head body are detachably connected by a bolt passing through the bolt hole.

In the preferred technical solution, the fixed connection structure comprises a connection plate. The bolt and the connection plate firmly connect the branch bodies of cylinder head body, such that the cylinder head body can bear a force perpendicular to the butting end faces. Bolted connection is easy to realize and has a high connection stability.

Preferably, the fixed connection structure comprises a first buckle and a second buckle respectively provided on two adjacent branch bodies of cylinder head body of the at least two branch bodies of cylinder head body. Two adjacent branch bodies of cylinder head body are detachably connected by buckling the first buckle on the second buckle.

In the preferred technical solution, the fixed connection structure is a buckle structure. The branch bodies of cylinder head body are detachably connected by the buckles, such that the cylinder head body can bear a force perpendicular to the butting end faces. Buckle connection is easy to realize and has a high connection stability.

Further, the branch bodies of cylinder head body have a branch body structure of end face flange. End face flange branch bodies of at least two branch bodies of cylinder head body are cooperatively positioned by means of the cooperative positioning structure and are detachably connected by means of the fixed connection structure to form an end face flange. The barrel protrudes by a predetermined length beyond the end face flange.

In the improved technical solution, the barrel protrudes, by a predetermined length, over the end face flange, the barrel is inserted in the groove of the flange welded on the cylinder barrel. Then the end face flange is connected to the flange welded on the cylinder barrel by a bolt, to better enable the branch bodies of cylinder head body to bear an axial force and a force perpendicular to the butting end faces of the branch bodies of cylinder head body, which further improves stability and reliability of connection and significantly enhances the tightness and stability of the mating between the cylinder head and the cylinder.

Further, the cooperative positioning structure comprises a bolt shaft and a bolt hole provided on the butting end faces of two adjacent branch bodies of end face flange of at least two branch bodies of cylinder head body. The bolt shaft is inserted into the bolt hole to realize cooperative mounting.

In the improved technical solution, the cooperative positioning structure further comprises a bolt hole provided on the butting end faces. Positioning and mating of the bolt hole and the bolt shaft make positioning of the branch bodies of cylinder head body more accurate, and further ensure that the butting end face is stressed uniformly at both sides when the branch bodies of cylinder head body are stressed axially.

Preferably, the at least two branch bodies of cylinder head body comprise a first branch body of cylinder head body and a second branch body of cylinder head body. The first branch body of cylinder head body and the second branch body of cylinder head body respectively have a first cylindrical branch body and a second cylindrical branch body. The cooperative positioning structure comprises a rabbet cooperatively formed by a concave rabbet and a convex rabbet respectively provided on the butting end faces of the first cylindrical branch body and the second cylindrical branch body. The fixed connection structure comprises a connection plate provided on the first cylindrical branch body and the second cylindrical branch body. The connection plate is provided with a bolt hole. The first cylindrical branch body and the second cylindrical branch body are cooperatively positioned by the rabbet and are detachably connected by means of a bolt passing through the bolt hole to form a barrel together.

In the preferred technical solution, the cylinder head body is composed of two branch body structures, i.e., a first branch body of cylinder head body and a second branch body of cylinder head body in a dismountable way. The first branch body of cylinder head body and the second branch body of cylinder head body are cooperatively positioned by means of the rabbet and are stably, reliably, fixedly connected by means of the bolt and the connection plate. Two branch body structures have two butting end faces. The cooperative positioning structure and the fixed connection structure are relatively simple. Correspondingly, production cost and dismounting cost are relatively low.

The present invention further provides a single cylinder bolt system having a cylinder head which comprises the abovementioned cylinder head body.

In the basic technical solution, the cylinder head body is especially suitable for a cylinder head in a single cylinder bolt system.

The present invention further provides a crane having the abovementioned single cylinder bolt system.

In the basic technical solution, the crane having the abovementioned single cylinder bolt system correspondingly has the abovementioned advantageous technical effects.

Thus, based on the abovementioned technical solution, the present invention provides a cylinder head body, which is composed of at least two branch bodies of cylinder head body in a dismountable way, which are cooperatively positioned and detachably connected by a cooperative positioning structure and a fixed connection structure, respectively, such that the cylinder head body may be dismounted into branch body structures during assembling, assembling manner thereof is not restricted by traditional assembling sequence, assembling efficiency and production efficiency are improved. Moreover, the cylinder head body is easy to dismount and maintain, which saves maintenance cost.

The single cylinder bolt system and the crane provided by the present invention correspondingly have the abovementioned advantageous technical effects.

BRIEF DESCRIPTION OF THE DRAWINGS

Drawings explained here are used to provide further understanding of the present invention, which constitute a portion of the present application. The schematic embodiments and description of the present utility model are only used for explaining the present invention, and do not constitute improper delimitations of the present invention.

In the drawings.

DETAILED DESCRIPTION OF THE EMBODIMENTS

The technical solution of the present invention will be further described in details through drawings and embodiments below.

Embodiments of the present invention are used for further explaining the inventive concept, the technical problem to be solved, the technical features constituting the technical solution and the technical effects of the present invention. It is necessary to explain that, description of these embodiments does not constitute delimitations of the present invention. Besides, the technical features involved in the embodiments of the present invention described below may be combined with each other as long as they do not conflict with each other.

As the assembling sequence of existing cylinder head bodies is fixed, assembling of the cylinder head bodies are not flexible, causing low production efficiency and difficult maintenance. Thus, the present invention designs a cylinder head body, which is composed of at least two branch bodies of cylinder head body in a dismountable way, which are cooperatively positioned and detachably connected by a cooperative positioning structure and a fixed connection structure, respectively, such that the cylinder head body may be dismounted into branch structures during assembling, assembling manner thereof is not restricted by traditional assembling sequence, assembling efficiency and production efficiency are improved. Moreover, the cylinder head body is easy to dismount and maintain, which saves maintenance cost.

Figure 1:
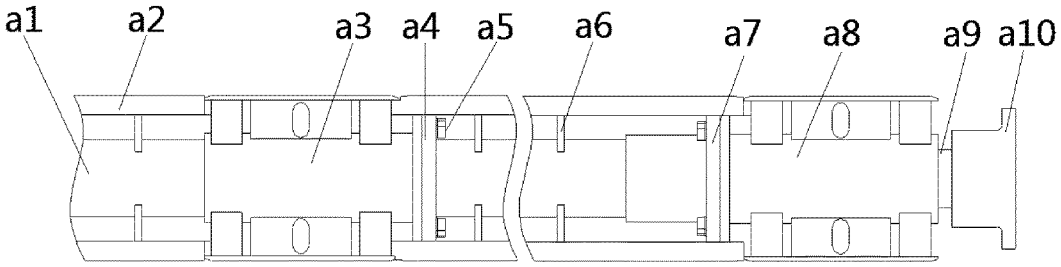
FIG. 1 is a schematic view of the structure of an existing cylinder head body.
Figure 2:
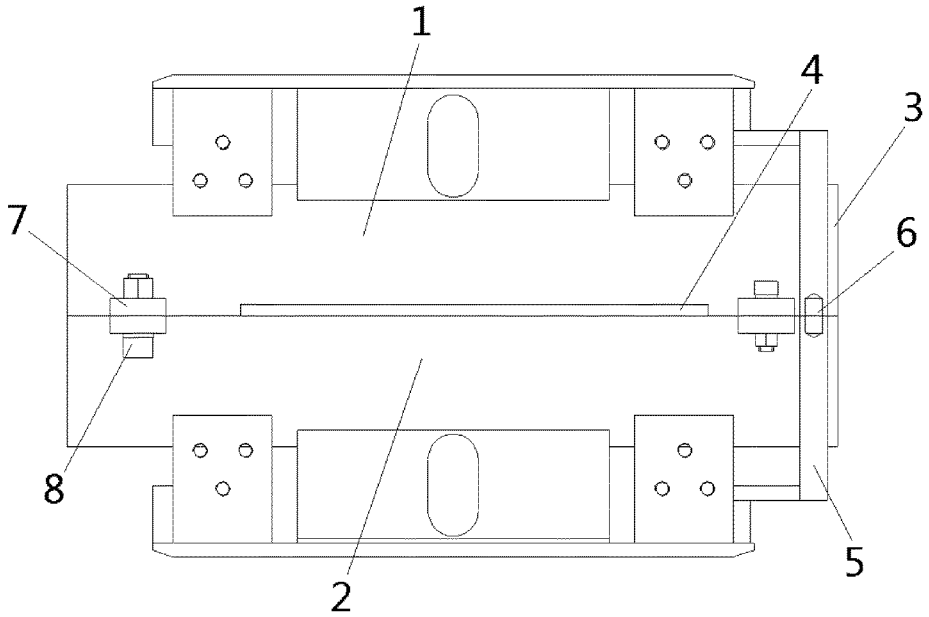
FIG. 2 is a schematic front view of the structure of an embodiment of a cylinder head body of the present invention.
Figure 3:
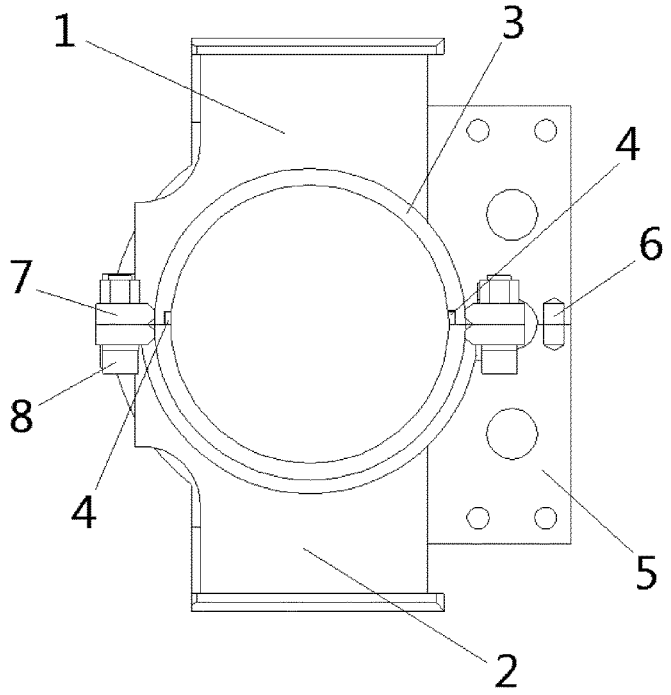
FIG. 3 is a schematic left view of the structure of an embodiment of a cylinder head body of the present invention.
Figure 4:
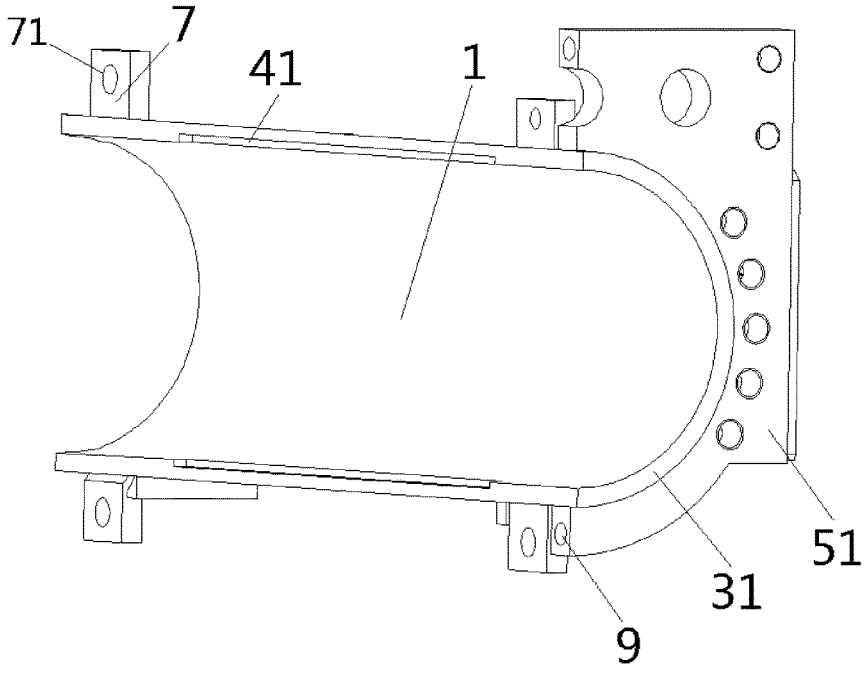
FIG. 4 is a schematic view of the structure of a first branch body of cylinder head body of the present invention.
Figure 5:
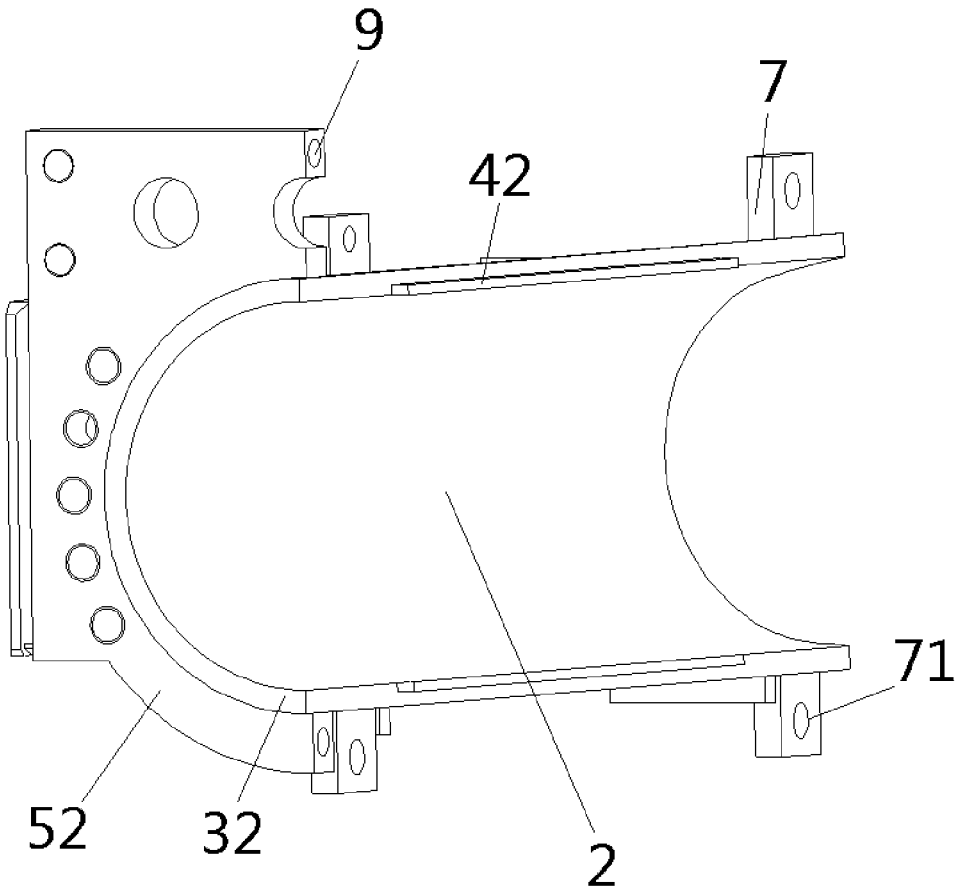
FIG. 5 is a schematic view of the structure of a second branch body of cylinder head body of the present invention.

FIG. 2 is a schematic view of the structure of an embodiment of a cylinder head body of the present invention. The cylinder head body is composed of two branch body structures, i.e., a first branch body 1 of cylinder head body and a second branch body 2 of cylinder head body. A cooperative positioning structure and a fixed connection structure are provided between the first branch body 1 of cylinder head body and the second branch body 2 of cylinder head body. The first branch body 1 of cylinder head body and the second branch body 2 of cylinder head body respectively have a first cylindrical branch body 31 and a second cylindrical branch body 32. The first cylindrical branch body 31 and the second cylindrical branch body 32 are cooperatively positioned by means of the cooperative positioning structure and are detachably connected by means of the fixed connection structure to form a barrel 3 together.

In the preferred schematic embodiment of the present invention, the cylinder head body is composed of the first branch body 1 of cylinder head body and the second branch body 2 of cylinder head body in a dismountable way, which are cooperatively positioned and detachably connected by the cooperative positioning structure and the fixed connection structure, respectively. During assembling, not influenced by the welded flange on the cylinder barrel, the cylinder head body may be mounted at both sides of the welded flange, which avoids that insertion direction and mounting side of traditional one-piece cylinder head bodies are fixed due to influence of the welded flange, and makes the assembling direction of the cylinder head body flexible. Correspondingly, the cylinder head body is not influenced by other components along the axial direction of the cylinder barrel during assembling and disassembling, and it has an advantage of convenient assembling, disassembling and maintenance. Besides, during assembling of the cylinder, the cylinder head body won't influence assembling of other components, which avoids influencing assembling of other components due to insufficient supply of cylinder head bodies and improves production efficiency.

As shown by FIGS. 2-5, the cooperative positioning structure comprises a rabbet 4 cooperatively formed by a concave rabbet 41 and a convex rabbet 42 respectively provided on the butting end faces of the first cylindrical branch body 31 and the second cylindrical branch body 32. The cooperative positioning structure uses a rabbet 4 for centering and connection. Positioning of the rabbet 4 is accurate, such that the first branch body 1 of cylinder head body and the second branch body 2 of cylinder head body are stressed axially into one piece, and the butting end faces of the first cylindrical branch body 31 and the second cylindrical branch body 32 are stressed uniformly at two sides when stressed axially, and the rabbet 4 is a connection device that is easy to machine and has favorable feasibility. The cooperative positioning structure may also be opposing concave and convex rabbet structures respectively provided on the two butting end faces of the first cylindrical branch body 31 and the second cylindrical branch body 32.

As shown by FIGS. 2-5, the cooperative positioning structure may also be a plurality of cooperating bosses and grooves respectively provided on the butting end faces of the first cylindrical branch body 31 and the second cylindrical branch body 32. The bosses and grooves are cooperatively positioned, such that the first branch body 1 of cylinder head body and the second branch body 2 of cylinder head body are stressed axially into one piece. Moreover, bosses and grooves are easy to machine and have favorable feasibility. Wherein, the plurality of bosses and grooves are provided equally or not equally spaced apart along the axial direction of the cylinder head body. Equally-spaced configuration is a preferred embodiment, which enables both sides of the butting end faces to be uniformly stressed when the first cylindrical branch body 31 and the second cylindrical branch body 32 are stressed axially. Certainly, the cooperative positioning structure may also be other conventional devices that can realize cooperating positioning.

As shown by FIGS. 2-5, the fixed connection structure comprises a connection plate 7 provided on the first cylindrical branch body 31 and the second cylindrical branch body 32. The connection plate 7 is provided with a bolt hole 71. The first branch body 1 of cylinder head body and the second branch body 2 of cylinder head body are cooperatively positioned by the rabbet 4 and are detachably connected by means of a bolt 8 passing through the bolt hole 71 to form a barrel 3 together. The bolt 8 and the connection plate 7 firmly connect the first branch body 1 of cylinder head body and the second branch body 2 of cylinder head body, such that the first branch body 1 of cylinder head body and the second branch body 2 of cylinder head body can bear a force perpendicular to the butting end faces. Moreover, bolted connection is easy to realize and has a high connection stability. The fixed connection structure may also comprise a first buckle and a second buckle respectively provided on the first branch body 1 of cylinder head body and the second branch body 2 of cylinder head body. The first branch body 1 of cylinder head body and the second branch body 2 of cylinder head body are detachably connected by buckling the first buckle on the second buckle. The first buckle and the second buckle firmly connect the first branch body 1 of cylinder head body and the second branch body 2 of cylinder head body, such that the first branch body 1 of cylinder head body and the second branch body 2 of cylinder head body can also bear a force perpendicular to the butting end faces. Moreover, buckle connection is easy to realize and has a high connection stability. Certainly, the fixed connection structure may also be other conventional devices that can realize fixed connection.

As an improvement of the abovementioned preferred schematic embodiment, as shown by FIGS. 2-5, the first branch body 1 of cylinder head body and the second branch body 2 of cylinder head body respectively have a first branch body of end face flange 51 and a second branch body of end face flange 52 which are cooperatively positioned by means of the cooperative positioning structure and are detachably connected by means of the fixed connection structure to form an end face flange 5. The barrel 3 protrudes by a predetermined length beyond the end face flange 5. The barrel 3 is machined such as to protrude, by a predetermined length, over the end face flange 5, the barrel 3 is inserted in the groove of the flange welded on the barrel 3. Then the end face flange 5 is connected to the flange welded on the cylinder barrel by a bolt, to better enable the first branch body 1 of cylinder head body and the second branch body 2 of cylinder head body to bear an axial force and a force perpendicular to the butting end faces of the first branch body 1 of cylinder head body and the second branch body 2 of cylinder head body, which further improves stability and reliability of connection of the cylinder head body and thus enhances the tightness and stability of the mating between the cylinder head and the cylinder. Further, as shown by FIGS. 2-5, the cooperative positioning structure further comprises a bolt shaft 6 and a bolt hole 9 provided on the butting end faces of the first branch body of end face flange 51 and the second branch body of end face flange 52. The bolt shaft 6 is inserted into the bolt hole 9 to realize cooperative mounting. Positioning and mating of the bolt hole 9 and the bolt shaft 6 make positioning of the first branch body 1 of cylinder head body and the second branch body 2 of cylinder head body more accurate, and further ensure that the butting end faces are stressed uniformly at both sides when the first branch body 1 of cylinder head body and the second branch body 2 of cylinder head body are stressed axially, further improving the connection stability and reliability of the cylinder head body. Certainly, the bolt shaft 6 may be directly welded on the butting end face of the first branch body of end face flange 51 or the second branch body of end face flange 52, so as to make positioning and mounting more convenient and rapid.

Thus, the mounting process of an embodiment of the present invention is as follows:

As shown by FIGS. 2-5, firstly, the first branch body 1 of cylinder head body and the second branch body 2 of cylinder head body are oppositely butted at both sides of the cylinder barrel, the concave rabbet 41 and the convex rabbet 42 of the first branch body 1 of cylinder head body and the second branch body 2 of cylinder head body are connected by insertion, at the same time, the bolt shaft 6 and the bolt hole 9 are cooperatively mounted in alignment, wherein the bolt shaft 6 is first put into the bolt hole 9 of either one of the first branch body of end face flange 51 and the second branch body of end face flange 52 and then it is mounted in cooperation with the bolt hole 9 of the other one; then the bolt 8 and the bolt hole 71 firmly connect the first branch body 1 of cylinder head body and the second branch body 2 of cylinder head body into one piece; finally, the barrel 3 which protrudes over the end face flange 5 is inserted in the groove of the flange welded on the cylinder barrel, and the end face flange 5 and the flange welded on the cylinder barrel are connected through a bolt.

The present invention further provides a single cylinder bolt system having a cylinder head which comprises the abovementioned cylinder head body. The cylinder head body of the present invention is not restricted by the assembling sequence, which realizes flexible mounting, convenient dismounting and maintenance, and is highly reliable. Correspondingly, the single cylinder bolt system provided by the present invention has the abovementioned advantageous technical effects and thus will not be repeated here.

The present invention further provides a crane. The crane has a single cylinder bolt system as described above. The cylinder head of the single cylinder bolt system of the present invention is not restricted by the assembling sequence during mounting and dismounting process of the cylinder head body, which realizes flexible mounting, convenient dismounting and maintenance, and is highly reliable.

Correspondingly, the crane provided by the present invention has the abovementioned advantageous technical effects and thus will not be repeated here.

The combined embodiments above describe the embodiments of the present invention in details, but the present invention is not limited to the described embodiments. For example, the cylinder head body may also be spliced into an one-piece structure by a plurality of branch body structures of cylinder head body (for example, three) in a dismountable way, or, butting may be realized by other positioning and fastening manners. For those skilled in the art, variations, modifications, equivalent substitutions and transformations of these embodiments without departing from the principles and essential spirits of the present invention shall still fall into the protection scopes of the present invention.

The invention claimed is:

1. A cylinder head body, comprising at least two branch bodies of cylinder head body, a cooperative positioning structure and a fixed connection structure are provided between two adjacent branch bodies of cylinder head body of the at least two branch bodies of cylinder head body, the branch body of cylinder head body has a cylindrical branch body structure, the cylindrical branch body structures of the at least two branch bodies of cylinder head body are cooperatively positioned by means of the cooperative positioning structure and are detachably connected by means of the fixed connection structure to form a barrel;

the cooperative positioning structure comprises a rabbet cooperatively formed by a concave rabbet and a convex rabbet provided on the butting end faces of two adjacent branch bodies of cylinder head body of the at least two branch bodies of cylinder head body, respectively.

2. The cylinder head body according to claim 1, wherein, the fixed connection structure comprises a connection plate provided on two adjacent branch bodies of cylinder head body of the at least two branch bodies of cylinder head body, the connection plate is provided with a bolt hole, two adjacent branch bodies of cylinder head body are detachably connected by a bolt passing through the bolt hole.

3. The cylinder head body according to claim 1, wherein, the fixed connection structure comprises a first buckle and a second buckle respectively provided on two adjacent branch bodies of cylinder head body of the at least two branch bodies of cylinder head body, two adjacent branch bodies of cylinder head body are detachably connected by buckling the first buckle on the second buckle.

4. The cylinder head body according to claim 1, wherein, the branch bodies of cylinder head body further have a branch body structure of end face flange, the branch body structures of end face flange of the at least two branch bodies of cylinder head body are cooperatively positioned by means of the cooperative positioning structure and are detachably connected by means of the fixed connection structure to form an end face flange, the barrel protrudes by a predetermined length beyond the end face flange.

5. The cylinder head body according to claim 4, wherein, the cooperative positioning structure further comprises a bolt shaft and a bolt hole provided on the butting end faces of two adjacent branch bodies of cylinder head body of the at least two branch bodies of cylinder head body, the bolt shaft is inserted into the bolt hole to realize cooperative mounting.

6. The cylinder head body according to claim 1, wherein, the at least two branch bodies of cylinder head body comprise a first branch body of cylinder head body and a second branch body of cylinder head body, which respectively have a first cylindrical branch body and a second cylindrical branch body, the cooperative positioning structure comprises a rabbet cooperatively formed by a concave rabbet and a convex rabbet respectively provided on the butting end faces of the first cylindrical branch body and the second cylindrical branch body, the fixed connection structure comprises a connection plate provided on the first cylindrical branch body and the second cylindrical branch body, the connection plate is provided with a bolt hole, the first branch body of cylinder head body and the second branch body of cylinder head body are cooperatively positioned by the rabbet and are detachably connected by means of a bolt passing through the bolt hole to form a barrel.

7. A single cylinder bolt system, having a cylinder head, the cylinder head comprises a cylinder head body according to claim 1.

8. A crane, comprising a single cylinder bolt system according to claim 7.

9. A cylinder head body, comprising at least two branch bodies of cylinder head body, a cooperative positioning structure and a fixed connection structure are provided between two adjacent branch bodies of cylinder head body of the at least two branch bodies of cylinder head body, the branch body of cylinder head body has a cylindrical branch body structure, the cylindrical branch body structures of the at least two branch bodies of cylinder head body are cooperatively positioned by means of the cooperative positioning structure and are detachably connected by means of the fixed connection structure to form a barrel;

the cooperative positioning structure comprises a plurality of cooperating bosses and grooves respectively provided on the butting end faces of two adjacent branch bodies of cylinder head body of the at least two branch bodies of cylinder head body.

10. The cylinder head body according to claim 9, wherein, the plurality of cooperating bosses and grooves are provided equally spaced apart along the axial direction of the cylinder head body.

11. The cylinder head body according to claim 9, wherein, the fixed connection structure comprises a connection plate provided on two adjacent branch bodies of cylinder head body of the at least two branch bodies of cylinder head body, the connection plate is provided with a bolt hole, two adjacent branch bodies of cylinder head body are detachably connected by a bolt passing through the bolt hole.

12. The cylinder head body according to claim 9, wherein, the fixed connection structure comprises a first buckle and a second buckle respectively provided on two adjacent branch bodies of cylinder head body of the at least two branch bodies of cylinder head body, two adjacent branch bodies of cylinder head body are detachably connected by buckling the first buckle on the second buckle.

13. The cylinder head body according to claim 9, wherein, the branch bodies of cylinder head body further have a branch body structure of end face flange, the branch body structures of end face flange of the at least two branch bodies of cylinder head body are cooperatively positioned by means of the cooperative positioning structure and are detachably connected by means of the fixed connection structure to form an end face flange, the barrel protrudes by a predetermined length beyond the end face flange.

14. The cylinder head body according to claim 13, wherein, the cooperative positioning structure further comprises a bolt shaft and a bolt hole provided on the butting end faces of two adjacent branch bodies of cylinder head body of the at least two branch bodies of cylinder head body, the bolt shaft is inserted into the bolt hole to realize cooperative mounting.

15. The cylinder head body according to claim 9, wherein, the at least two branch bodies of cylinder head body comprise a first branch body of cylinder head body and a second branch body of cylinder head body, which respectively have a first cylindrical branch body and a second cylindrical branch body, the cooperative positioning structure comprises a rabbet cooperatively formed by a concave rabbet and a convex rabbet respectively provided on the butting end faces of the first cylindrical branch body and the second cylindrical branch body, the fixed connection structure comprises a connection plate provided on the first cylindrical branch body and the second cylindrical branch body, the connection plate is provided with a bolt hole, the first branch body of cylinder head body and the second branch body of cylinder head body are cooperatively positioned by the rabbet and are detachably connected by means of a bolt passing through the bolt hole to form a barrel.

16. A single cylinder bolt system, having a cylinder head, the cylinder head comprises a cylinder head body according to claim 9.

17. A crane, comprising a single cylinder bolt system according to claim 16.

* * * * *